US005416990A

United States Patent [19]

Otwell

[11] Patent Number: 5,416,990

[45] Date of Patent: May 23, 1995

[54] EXCAVATION BUCKET

[76] Inventor: William C. Otwell, 758 NW. Holland Rd., Rome, Ga. 30165-8865

[21] Appl. No.: 165,296

[22] Filed: Dec. 13, 1993

[51] Int. Cl.[6] ..... E02F 3/407

[52] U.S. Cl. ..... 37/445; 414/722; 37/444; 37/379

[58] Field of Search ..... 37/445, 444, 443, 411, 37/418, 379, 398; 414/722, 725; 172/371, 378, 381; 294/55, 51, 54.5, 63.26

[56] References Cited

U.S. PATENT DOCUMENTS

| | | | |
|---|---|---|---|
| 1,824,989 | 9/1931 | Fundon | 414/722 X |
| 2,203,713 | 6/1940 | Austin | 37/418 |
| 2,959,305 | 11/1960 | Konefes | 37/445 X |
| 3,056,219 | 10/1962 | Jeffrey | 414/722 X |
| 3,247,606 | 4/1966 | Page | 37/398 |
| 3,775,879 | 12/1973 | Quick | 37/444 X |
| 3,792,539 | 2/1974 | Clark | 37/444 X |
| 3,869,054 | 3/1975 | Moreau | 37/444 |
| 3,897,641 | 8/1975 | Moser | 414/722 X |
| 4,157,956 | 6/1979 | Robinson | 414/722 X |
| 5,253,449 | 10/1993 | Webb et al. | 37/444 X |

*Primary Examiner*—Randolph A. Reese
*Assistant Examiner*—Victor Batson
*Attorney, Agent, or Firm*—Jones & Askew

[57] ABSTRACT

An excavation bucket with a scoop provided at a bottom portion of the bucket to provided fine digging and grading of materials or trenches. The excavation bucket is particularly useful for digging trenches near utilities and finishing trenches at proper grade.

16 Claims, 3 Drawing Sheets

EXCAVATION BUCKET

FIELD OF THE INVENTION

This invention relates to an excavation bucket, particularly a backhoe or excavator bucket, having a scoop on the bottom thereof to fine grade.

BACKGROUND OF THE INVENTION

Excavation equipment with excavation buckets for digging and grading have been known for many years. The buckets themselves have been developed and refined over the years to increase the digging efficiency of such devices.

The backhoe bucket has been developed to have generally triangular side plates connected together with an arcuate bottom plate. The leading edge of the bucket is defined by the leading edge of the arcuated bottom plate located at the entrance into the bucket, and may be provided with a plurality of teeth to improved digging action. The rear of the bucket is provided with mounting plates having holes for mounting onto the arm of a backhoe.

In this conventional configuration, the arcuate bottom plate is a continuous plate extending from the front of the bucket to the rear of the bucket. In use, the bucket is rotated by the backhoe arm while being forced into the material being handled. Thus, the arcuate bottom plate slides relative to the material and provides little resistance.

When digging trenches with a conventional backhoe bucket, the backhoe bucket is particularly effective for digging the trench quickly. However, the conventional backhoe bucket becomes difficult to operate when working near building foundations, or when carefully removing small layers of earth covering, for example, existing electrical cables, water mains, or other utilities, increasing the possibility of damaging such utilities when uncovering.

Further, when laying pipe or other conduit, the final grading of the trench must be carefully and precisely made to ensure proper slope and foundation for the pipe or conduit. This type of operation is difficult to perform with the conventional backhoe bucket.

SUMMARY OF THE INVENTION

An object of the present invention is to provide an improved excavation bucket, particularly an improved backhoe bucket.

Another object of the present invention is to provide an excavation bucket with a scoop on the bottom thereof to allow fine grading with the improved excavation bucket.

A further object of the present invention is to provide an excavation bucket that can be used in one mode for digging, and in another mode for grading.

The excavation bucket according to the present invention utilizes a conventional configuration, however, modified with a scoop provided on a bottom of the bucket. This configuration allows the bucket to be utilized in its conventional configuration for fast digging in a first mode while providing fine grading with the scoop in a second mode.

The scoop in operation has a fixed configuration that allows for a limited amount of material to be dug. The height of the scoop limits the depth of material being dug. Specifically, the front curved surface positioned in front of the scoop acts as a guide while a fixed depth amount of material is dug by the scoop. Thus, a very accurate depth of material can be dug by the excavation bucket according to the present invention.

The scoop is located so that the bucket will still retain a substantial amount of material while digging and removing without material exiting back through the scoop. Specifically, the scoop is located in the bottom of the bucket so that there exists a substantial rear curved bottom section behind the scoop that serves to collect material inside that bucket that is dug by the scoop. Thus, the rear curved bottom section provides a bucket portion that can retain material to allow complete excavation and removal by the bucket.

The performance of the bucket according to the present invention can be improved by providing means for closing the scoop to prevent material entering the bucket from exiting through the scoop. This optional feature can be important during the first mode of operation wherein the front of the bucket is used for digging in a conventional manner (i.e. the capacity of the bucket is being fully utilized to remove material as quickly as possible).

It is possible to provide a control valve at the scoop or other means for selectively controlling the movement of material through the scoop. However, such means would tend to be complex and not durable enough to withstand heavy digging. Thus, a passive one-way type valve such as a resilient flap is particularly suitable for use in the present invention.

A resilient flap, for example, made of molded rubber composition, is optionally provided to act as a one-way valve for material passing through the scoop into the bucket while preventing material flow in the opposite direction. The resilient flap is preferably mounted within the scoop to prevent damage thereto during operation of the bucket. The flap can be mounted to extend downwardly from a trailing edge of a front curved bottom section of the bucket, or can be mounted to extend upwardly from a leading edge of a rear bottom section of the bucket. The free end of the resilient flap must contact and cooperate with other structure inside the bucket acting as a stop to prevent its rotation when operating in a mode to prevent material from escaping from the bucket.

The wear characteristics of the bucket can be enhanced by providing wear plates and guides at appropriate positions on the bucket. For example, a wear plate can be provided either above or below, or both relative to the leading edge of the rear curved bottom section at the scoop. This prevents wear to the leading edge of the rear curved bottom section. The wear plates can be mounted to be replaced or removed and repaired as required. Likewise, a lower wear plate can be provided at the trailing edge of the front curved bottom section.

The wear plate(s) and combination of wear plates can be provided for changing or modifying the configuration of the scoop. Specifically, the wear plates can be added to make the scoop effectively larger or smaller. Further, the leading edges of the wear plates can be selected to carry out various functions (e.g. beveled cutting edge).

The leading edge of the rear curved bottom section can be beveled to provide a cutting edge. Further, the wear plate(s) can be provided with a beveled cutting edge at the leading edge thereof. The wear plate(s) can be positioned to provide a double or triple cutting edge, or can be positioned to provide a continuous cutting edge/surface with the beveled cutting edge of the rear curved bottom section of the bucket.

BRIEF DESCRIPTION OF THE INVENTION

DETAILED DESCRIPTION OF PREFERRED EMBODIMENTS

The present invention is directed to excavation bucket, in particular backhoe and excavator type buckets for trenching. However, the present invention can be applied to other types of buckets such as front loaders and other types of excavation equipment.

Figure 1:
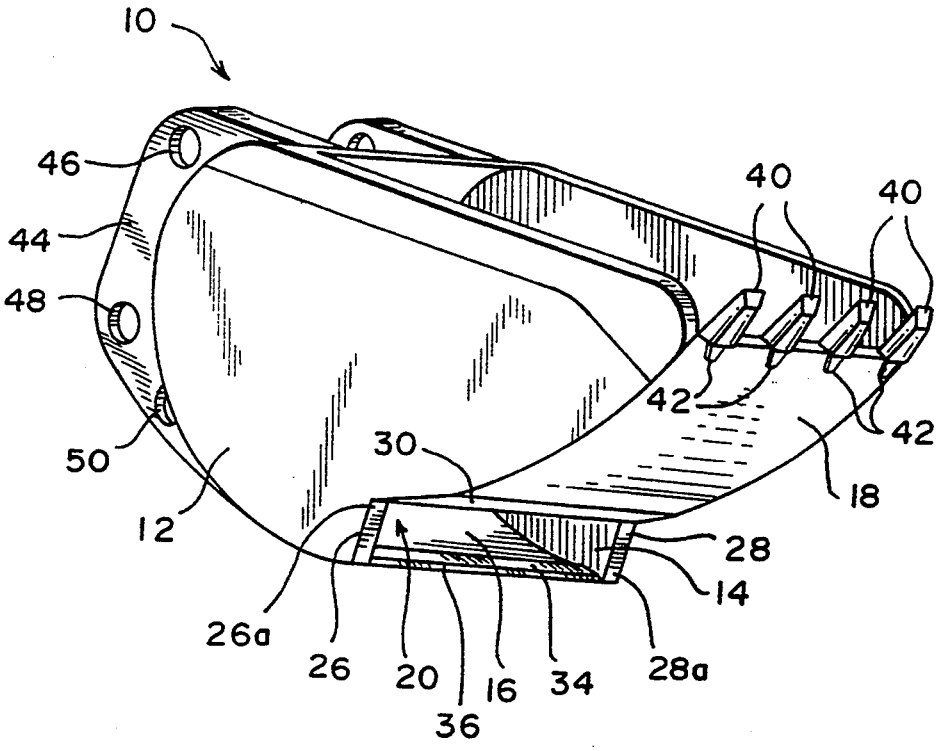
FIG. 1 is a perspective view of an embodiment of the excavation bucket according to the present invention.
Figure 2:
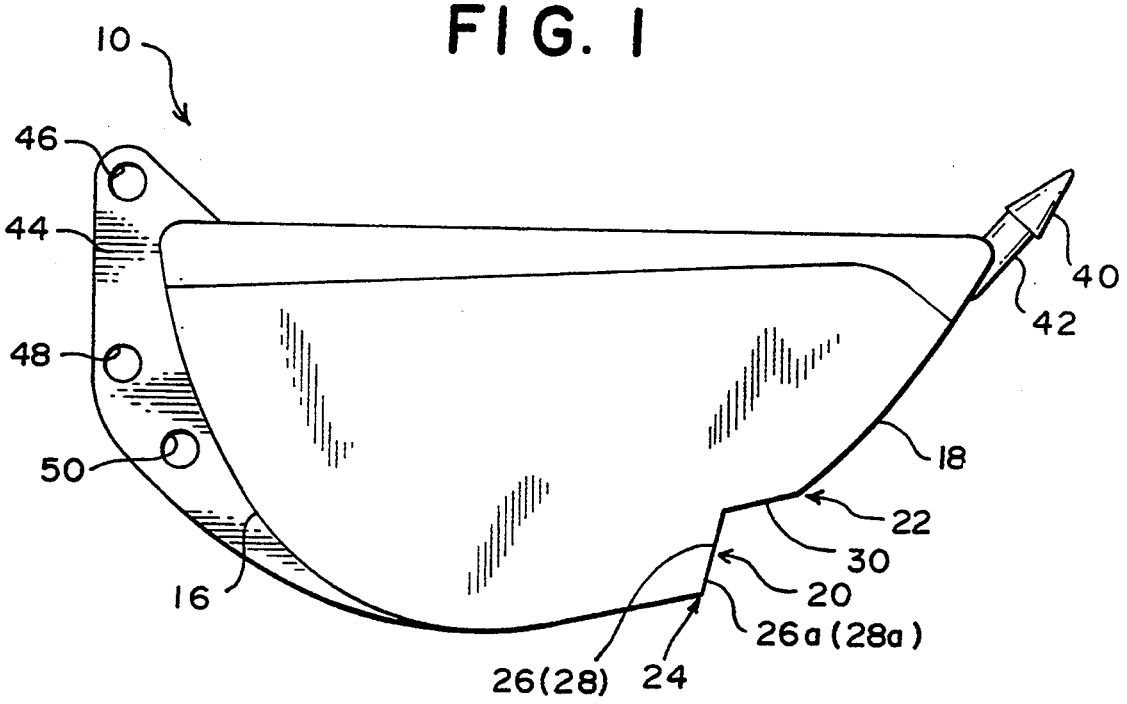
FIG. 2 is a side elevational view of the bucket as shown in FIG. 1.
Figure 3:
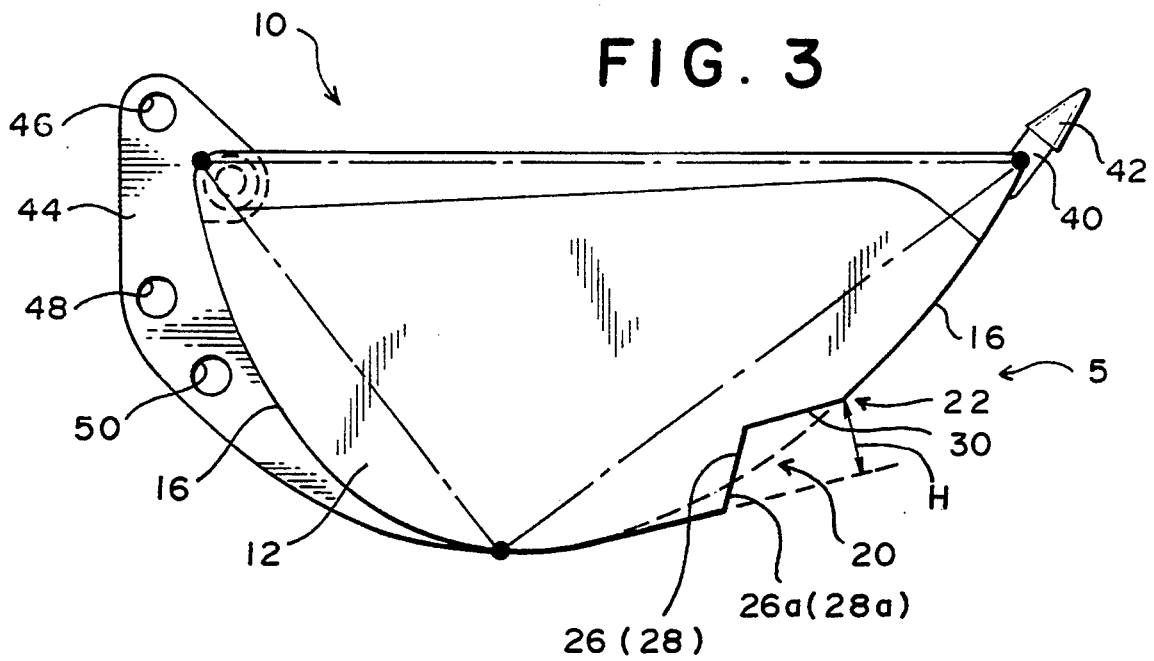
FIG. 3 is a side elevational view of the bucket shown in FIG. 2 indicating the triangular configuration of the side plates.

A preferred embodiment of an excavation bucket 10 according to the present invention is shown in FIGS. 1–3. The excavation bucket comprises a pair of side plates 12, 14 connected together by a rear curved bottom section 18 and a front curved bottom section 16. The side plates 12, 14 have a generally triangular configuration as shown in FIG. 3.

Figure 4:
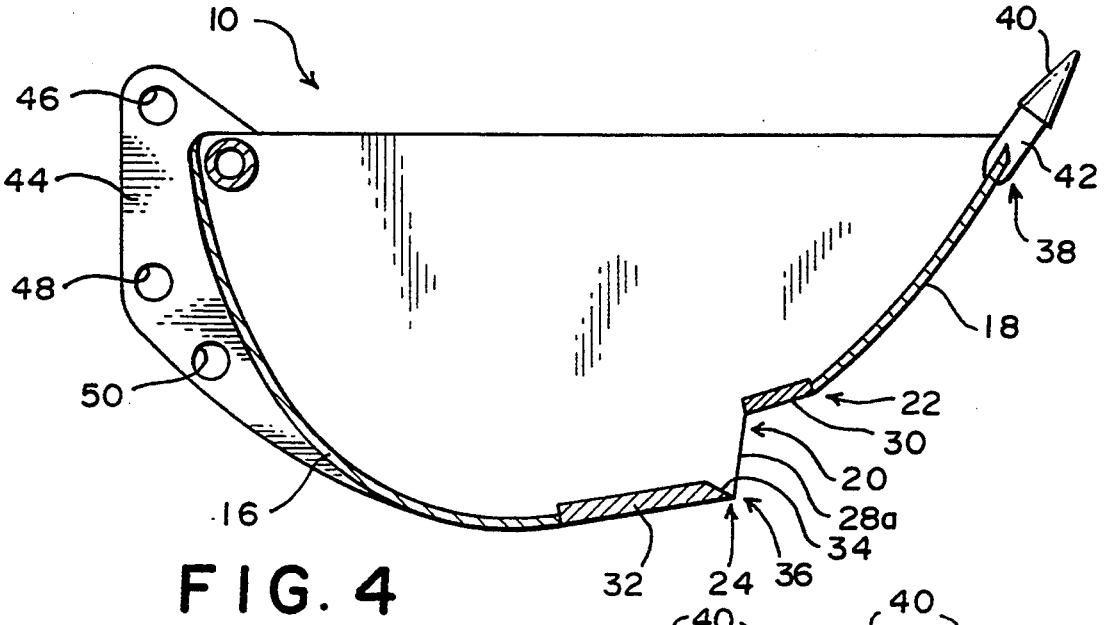
FIG. 4 is a lengthwise cross-sectional view of the bucket shown in FIG. 2.
Figure 5:
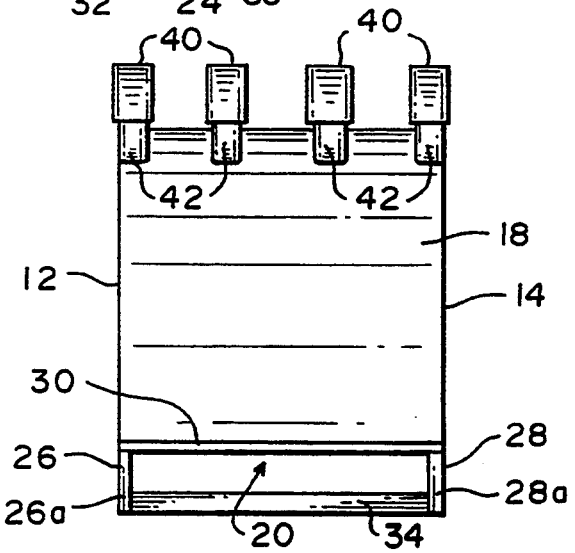
FIG. 5 is a front elevational view of the bucket shown in FIG. 2.

The rear curved bottom section 16 and front curved bottom section 18 are set apart a distance to define a scoop 20. Specifically, the scoop 20 is defined by the trailing edge 22 of the front curved bottom section 18, the leading edge 24 of the rear curved bottom section 16, and triangular notched portions 26, 28 in the side plates 12, 14. The triangular notched portions 26, 28 expose forward facing surfaces **26*a*, 28*a*. The triangular notched portions 26, 28 in sides 12, 14 also connect to transverse plate 30 further defining the entrance to the scoop 20. The transverse plate 30 is welded to the side plates 12, 14 and to the trailing edge 22 of the front curved bottom section 18. The rear curved bottom section includes a grading plate 32 welded to the side plates 12, 14. The grading plate 32 is provided with a beveled cutting edge 34, as shown in FIG. 4. The beveled cutting edge 34 provides a cutting edge 36** to facilitate fine grading.

The leading edge 38 of the front curved bottom section 18 can be provided with a plurality of teeth 40 connected to the leading edge 38 by supports 42 welded thereto.

The backhoe bucket 10 is provided with means for connecting the backhoe bucket to excavation equipment. For example, a pair of connector plates having mounting holes 46, 48, 50, are welded to the rear curved bottom section 18.

The orientation of the grading plate 32 relative to the transverse plate 30 can be substantially parallel as shown, or can vary depending on the particular scoop configuration desired.

Figure 6:
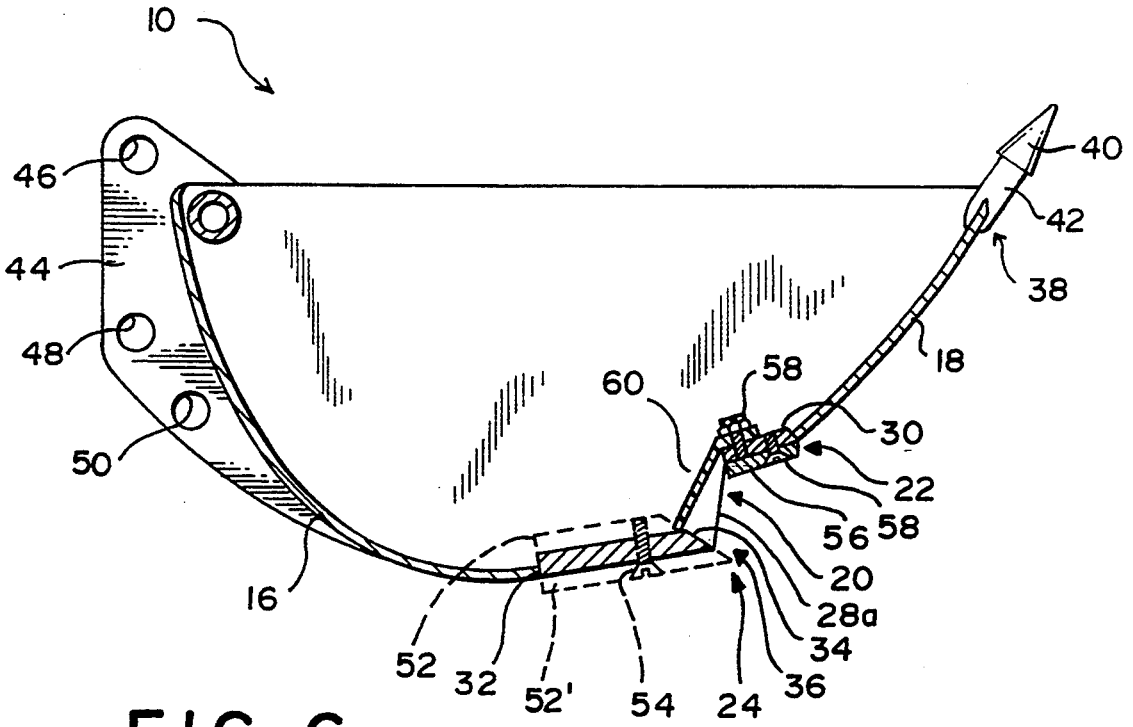
FIG. 6 is a lengthwise cross-sectional view of the bucket shown in FIG. 4, however, with the addition of optional features.

The backhoe bucket 10 can be provided with optional features, as shown in FIG. 6.

The grading plate 32 can optionally be provided with an upper wear plate 52, or a lower wear plate 52', or both. The wear plate(s) can be secured to the grading plate 32 by one or more threaded fasteners 54, or by other conventional means. The application of the wear plate(s) modifies the dimensions and configuration of the scoop 20 to be larger or smaller as desired for a particular application. Further, the angle of the lower leading edge of the scoop can be modified by simply changing the angle of the leading edge of the wear plate(s).

In addition, the wear plate(s) can be provided with a beveled cutting edge at the leading edge thereof providing the possibility of twin or triple cutting edges. In an embodiment in which the grading plate 32 is provided with a beveled cutting edge 34, the wear plate(s) can be positioned so that the beveled cutting edges are continuous, as shown in FIG. 6.

The transverse plate 30 can optionally be provided with a lower wear plate 56. The wear plate 56 can be secured to the transverse plate 30 by one or more threaded fasteners 58, or by other conventional means. The application of the wear plate 56 modifies the dimensions and configuration of the scoop 20 to be smaller as desired for a particular application. Further, the angle of the upper leading edge of the scoop can be modified by simply changing the angle of the leading edge of the wear plate 56.

The wear plates 52, 52', and 56 described above can be replaced, or removed and repaired when worn or damaged. Further, various combinations of wear plates can provide numerous configurations tailored to particular applications.

The scoop 20 can be provided with a resilient flap 60 (e.g. rubber flap) to allow material to enter the bucket 10 while preventing material once in the bucket from undesirably exiting the bucket 10 back through the scoop 20. The resilient flap can be fabricated or molded to a variety of different configurations suitable to accomplish this task. For example, the resilient flap 60 can have an upside down L-shaped configuration. A metal strip secured by one or more threaded fasteners can securely fasten the resilient flap 60 to the transverse plate 30.

In the embodiment shown in FIG. 6, the resilient flap 60 is connected to the trailing edge of the front curved bottom section 18, and extends downwardly blocking the mouth of the scoop 20. The resilient flap 60 is of sufficiently length that it contacts with the upper surface of the grading plate 32 acting as a stop preventing its further rotation to prevent material from exiting the bucket 10 through the scoop 20.

In an alternative embodiment, the resilient flap 60 can be attached to the grading plated 32, and extend upwardly therefrom potentially providing greater retention of material in the bucket verses the embodiment shown in FIG. 6 (i.e. resilient flap 60 extending downwardly).

Figure 7:
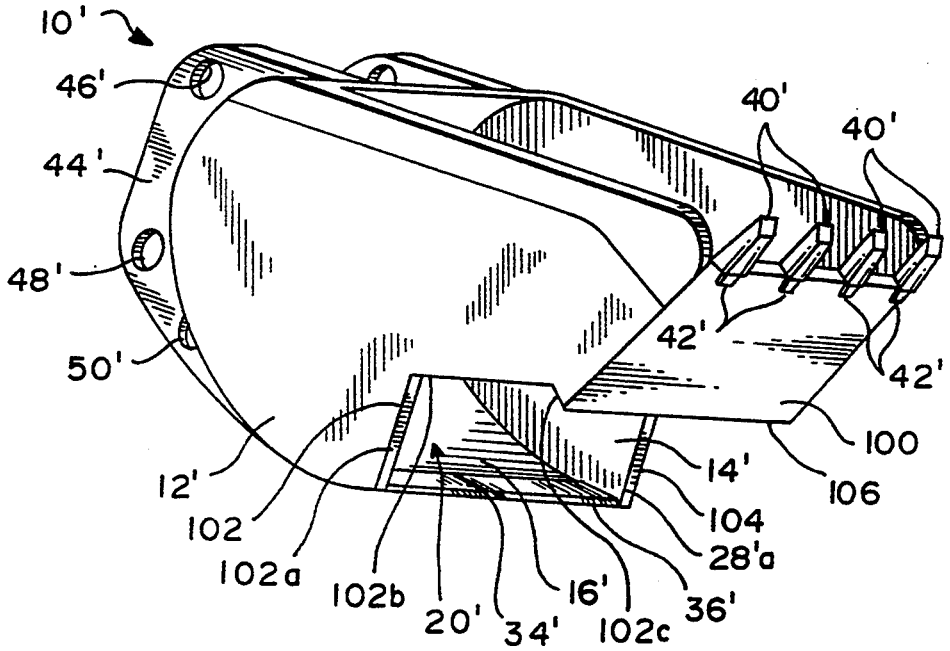
FIG. 7 is a perspective view of another embodiment of the buckets according to the present invention.

Another embodiment of a backhoe bucket 10' according to the present invention is shown in FIG. 7.

In this embodiment, the curve front bottom section 18 in the embodiment of FIG. 1, is replaced with a flat bottom section 100. Further, the sides 12', 14' are provided with a C-shaped notch 102, 104 exposing surfaces such as **102*a* and 102*b*. A transverse face 106 is exposed in the entrance of the scoop 20'. The transverse face 106** can be used for grading when the backhoe bucket 10' is moved away from the excavation equipment while the cutting edge 36' is used for grading when pulling the backhoe bucket 10' toward the excavation equipment.

OPERATION

The operation of the backhoe bucket 10 as shown in FIGS. 1–6 will now be described in detail.

The backhoe bucket 10 is mounted on the end of the arm of a backhoe in a conventional manner. When initially beginning excavation of a trench, for example, the teeth 40 are utilized for quickly removing substantial quantities of earth to dig down just above the desired final grade for the trench. Then, the operator rolls the bucket 10 and begins fine grading with the grading plate 32 of the scoop 20. Specifically, the bucket is rolled so that the cutting edge 36 is placed in contact with the lower surface of the trench, and then the operator continues to force the bucket 10 downwardly while pulling the bucket toward the backhoe to cause fine grading of the lower surface of the trench. The height M of the scoop 20 as shown in FIG. 3, dictates the depth of earth being removed with each forward path of movement of the bucket. Thus, the height H of the scoop 20 dictates the maximum amount of earth that can be removed with each path of forward movement of the backhoe bucket 10. Thus, the bottom of the trench can be carefully graded in a very controlled manner to allow the operator to either carefully dig down toward utilities, or for final grading of the bottom of the trench.

I claim:

1. An excavation bucket, comprising:

a pair of parallel side plates;

a rear curved bottom section connecting together said pair of parallel side plates at a rear portion of the excavation bucket;

a front curved bottom section connecting together said pair of parallel side plates at a front portion of the excavation bucket, said rear curved bottom section and said front curved bottom section are set apart and configured to define a scoop in a bottom of the excavation bucket to allow fine grading with said scoop; and an attachment for attaching the excavation bucket to excavation equipment.

2. An excavation bucket according to claim 1, wherein said rear curved bottom section includes a leading edge for fine grading located at an entrance into said scoop.

3. An excavation bucket according to claim 2, wherein said leading edge is a straight leading edge.

4. An excavation bucket according to claim 1, wherein said parallel side plates are provided with triangular notches defining an entrance into said scoop.

5. An excavation bucket according to claim 2, wherein said parallel side plates are provided with triangular notches defining an entrance into said scoop.

6. An excavation bucket according to claim 2, wherein said leading edge of said rear curved bottom section extends below a trailing edge of said front curved bottom section defining said scoop.

7. An excavation bucket according to claim 2, wherein said rear curved bottom section is provided with an upper wear plate at said leading edge.

8. An excavation bucket according to claim 2, wherein said rear curved bottom section is provided with a lower wear plate at said leading edge.

9. An excavation bucket according to claim 2, wherein said rear curved bottom section is provided with both an upper and lower wear plate at said leading edge.

10. An excavation bucket according to claim 1, wherein a trailing edge of said front curved bottom section is provided with a lower wear plate.

11. An excavation bucket according to claim 1, wherein the bucket is provided with a resilient flap covering said scoop to allow material to enter through the scoop into the bucket while preventing material from exiting through the scoop.

12. An excavation bucket according to claim 11, wherein said resilient flap is connected to a trailing edge of said front curved bottom section and extends downwardly with an end contacting a upper surface of a leading edge of said rear curved bottom section acting as a stop.

13. An excavation bucket according to claim 11, wherein said resilient flap is connected to a leading edge of said rear curved bottom section and extends upwardly therefrom.

14. An excavation bucket according to claim 1, wherein a leading edge of said rear curved bottom section is provided with a wear plate having a beveled cutting edge.

15. An excavation bucket according to claim 14, wherein said leading edge of said rear curved bottom section is continuous with said beveled cutting edge of said wear plate.

16. An excavation bucket according to claim 1, wherein said rear curved bottom section defines a bucket portion capable of collecting substantial material inside the bucket entering through said scoop.

* * * * *